United States Patent [19]

Moiroux et al.

[11] 4,142,485

[45] Mar. 6, 1979

[54] METHOD AND DEVICE FOR ENSURING THE SAFETY IN A FREE PISTON MACHINE

[76] Inventors: Auguste F. Moiroux, 28 route de Dardilly, Ecully (Rhone); Francois Bernard, 105 Cours du Docteur Long, Lyon 3°, both of France

[21] Appl. No.: 846,081

[22] Filed: Oct. 27, 1977

Related U.S. Application Data

[63] Continuation of Ser. No. 611,114, Sep. 8, 1975, abandoned, which is a continuation of Ser. No. 376,995, Jul. 6, 1973, abandoned.

[30] Foreign Application Priority Data

Jul. 7, 1972 [FR] France ..... 72.25655

[51] Int. Cl.[2] ..... F02B 71/00

[52] U.S. Cl. ..... 123/46 R; 123/46 SC; 60/DIG. 1; 417/364

[58] Field of Search ..... 123/46 R, 46 SC, 46 A, 123/46 B; 417/364; 60/DIG. 1

[56] References Cited

FOREIGN PATENT DOCUMENTS 787715 7/1935 France ..... 123/46 R 250734 7/1948 Switzerland ..... 123/46 R

*Primary Examiner*—Wendell E. Burns

*Attorney, Agent, or Firm*—Sughrue, Rothwell, Mion, Zinn and Macpeak

[57] ABSTRACT

The invention relates to the safety against shocks in a free piston machine.

The engine section of a unit operating according to the Diesel cycle and air-cooled runs the risk of supplying an important amount of energy to the piston, so that the latter might knock against the cover of the bounce cylinder or chamber. The constructional elements (stroke and diameters) of the machine are calculated in a manner such that their ratios cause, as a result of expansion, the ignition to stop before the dead point on the bounce section side (curve 12) knocks against the cylinder.

Application: compressor with 2-stroke Diesel engine, having a one-piece movable member, and air-cooled.

1 Claim, 2 Drawing Figures

METHOD AND DEVICE FOR ENSURING THE SAFETY IN A FREE PISTON MACHINE

This is a Continuation of application Ser. No. 611,114, filed Sept. 8, 1975, now abandoned, which in turn, was a continuation application of Ser. No. 376,995 filed July 6, 1973, now abandoned.

The present invention relates to the stability and the safety of a direct-action compressor fitted with a one-piece piston driven by an air-cooled Diesel engine.

The way by which the safety against shocks is obtained in the known variable stroke machines, such as, for instance, free piston generators, is known:

in water-cooled machines, a slight excess of driving air $\lambda$ (where $\lambda$ refers to excess air in the fuel/air mixture i.e. when $\lambda = 0$ there is just sufficient air to burn all of the fuel, but no excess) may be allowed, as the high corresponding temperatures are subdued by the cooling. When the quantity of fuel injected increases, the driving work increases. Steps are taken in order that, when that limit value of $\lambda$ which allows the combustion is equal to 1.5, the movable member arrives exactly close to the stationary part;

in those air-cooled machines which operate according to a cycle including pre-mixing and controlled ignition, the energy is limited by the richness of the mixture, and there is no problem of overcombustion;

in the case of a variable stroke machine which is air-cooled and operates according to the Diesel cycle, it is necessary to provide a high excess of air for the cooling. Thereby, there is a much greater risk of overinjection: with $\lambda = 3$, it is possible to double the energy supplied by the motor, as compared with limit $\lambda = 1.5$. It is no longer possible then constructionally to provide an adequate stroke which ensures the safety against shocks for such an excess of energy, and another solution must be found.

The object of the present invention is to solve the above-mentioned problem by providing a safety device for a machine driven by an air-cooled Diesel engine, and including at least one free piston having a variable stroke.

A Diesel machine with a variable stroke free piston, and air-cooled and built according to the invention, is characterized in that the safety against shocks for the movable member is obtained through the absence of ignition of the fuel in the engine beyond the limit position set to one of the two dead points of the movable members.

According to another feature of the invention, a limit position of safety is set to the dead point of the bounce piston of the movable member, the latter including, besides, at least one engine piston and one compressor piston.

According to another feature of the invention, the movable member is constituted by several pistons of revolution, which are coaxial and define: an engine section; a cushion of air; a compression unit consisting of two chambers, the volumes of which are alternately increasing and then decreasing. The diameters of the pistons constituting the member may be different.

According to another feature of the invention, the safety of the machine is obtained by setting a minimum value and a maximum value, that is, a margin of variation, for the three following ratios: $\phi C/\phi M$, $\phi m/\phi M$, and $C/\phi M$, wherein $\phi C$ = diameter of the compressor cylinder and piston, $\phi M$ = diameter of the engine cylinder and piston, $\phi m$ = diameter of the bounce cylinder and piston, $C$ = stroke of the movable member.

According to another feature of the invention, the ratio of the diameters of the compressor piston and the engine piston is defined by the following extreme values:

$$1.6 < (\phi c/\phi M) < 1.9$$

According to another feature of the invention, the ratio of the diameter of the bounce piston to that of the engine piston is defined by the following extreme values:

$$0.8 < (\phi m/\phi M) < 1.2$$

According to another feature of the invention, the ratio of the maximum stroke of the movable member to the diameter of the engine piston is defined by the following extreme values:

$$1.5 < (C/\phi M) < 1.8$$

The appended drawing, given by way of non-limiting example, will enable the features of the invention to be better understood.

Figure 1:
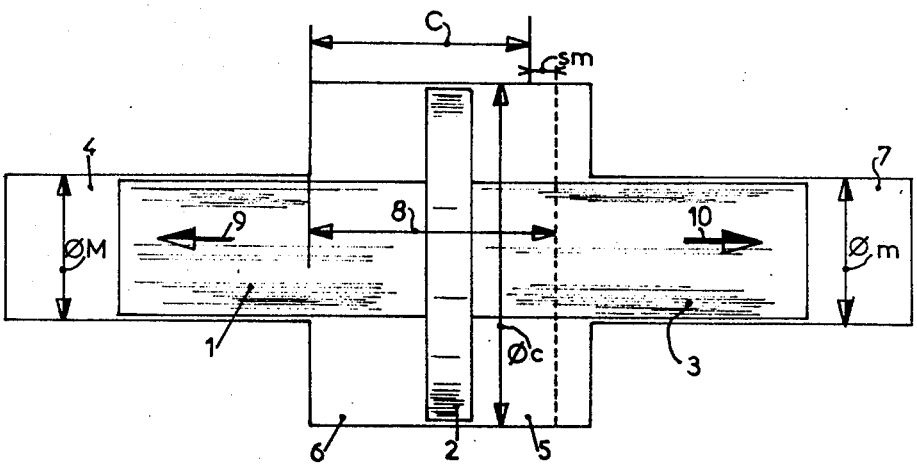
FIG. 1 is an axial sectional view of a variable stroke machine, the one-piece movable member of which acts both as an engine and a compressor.

FIG. 1 shows a one-piece movable member which follows a rectilinear reciprocating motion. It is constituted by at least: one engine piston 1 which slides within the engine cylinder 4 of a diameter $\phi M$; a bounce piston 3 which slides within the bounce cylinder 7 of a diameter $\phi m$; a compressor piston 2, the diameter $\phi c$ of which is higher than those of the two other pistons. The piston 2, which is disposed in the middle portion of the member, slides within the compressor cylinder and defines two chambers therein, to wit, a compression chamber 5 on the bounce side, and a chamber 6 for the scavenging and admission air for the engine. The volumes of these two chambers increases and decreases alternately, depending on the direction of travel of the member, the maximum stroke C of which is shorter than the axial length 8 of the compressor cylinder. The diameters $\phi M$, $\phi m$, $\phi c$ are calculated in a manner such that the combustion in the engine stops being ignited before the movable member comes and knocks against the end of a cylinder.

Figure 2:
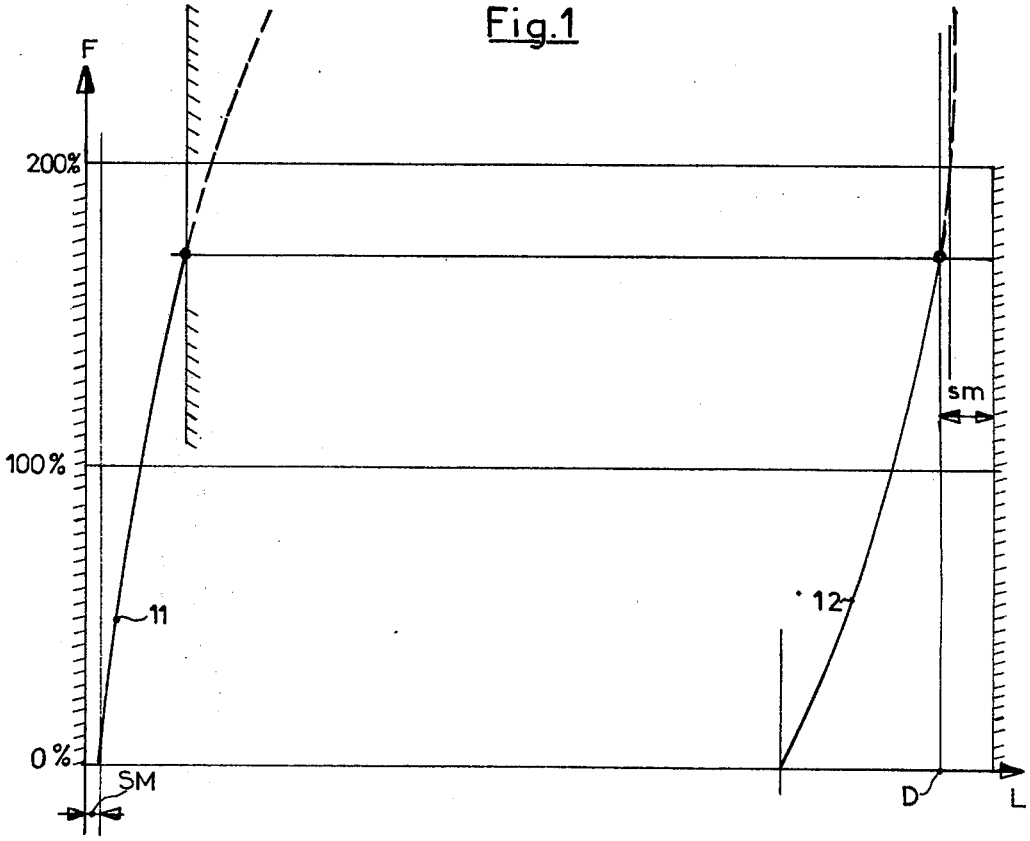
FIG. 2 is a graph showing the evolution of the positions of the dead points of the movable member on the engine side and on the bounce side, said evolution being plotted as a function of the load of the engine.

FIG. 2 shows the evolution of the ends of the engine piston 1 and bounce piston 3 during the operation of the machine (curves 11 and 12).

The operation is as follows

When the movable member travels in the direction of the arrow 9, the air is compressed in the engine cylinder 4. When a certain pressure is reached, the fuel injected is ignited; the member changes its direction and moves in the direction of the arrow 10 under the action of the pressure from the exhaust gases. The dead point of the piston 1 remains lying well before the end of the engine cylinder 4 (FIG. 1), and the machine always keeps a safety gap SM against the shocks on the head of the engine. (FIG. 2).

On the contary, when the member travels in the direction of the arrow 10, there is a risk that it comes to knock against the cover of the bounce cylinder 7, and such a risk increases together with the energy supplied by the engine. The value of said energy varies increasingly as the volume of the fuel burnt, and therefore injected. Now, in the case of a Diesel engine, air-cooled, a substantial excess of air must be provided, as said air is used for cooling the engine. This excess of air allows a good combustion, even in the event of an overinjection of fuel, which is dangerous since the combustion is started by the spontaneous ignition of the gasoil in the air raised at a high temperature by the compression thereof in the engine cylinder.

To prevent shocks against the cover of the bounce cylinder or the compressor cylinder in such a machine, the present invention aims at limiting the temperature of compression in the combustion chamber 4 of the engine. For this reason, the fuel is not ignited as soon as the dead point on the bounce side tends to pass beyond the position D (FIG. 2) which is the limit position for safety. Thus, the invention allows the engine to stop automatically for lack of ignition if the dead point on the bounce cylinder side happens to come nearer to the cylinder cover than the distance SM required for safety. This requirement is obtained by dosing the driving energy accurately, that is, by calculating and studying accurately the parameters which are essential for building the machine, to wit: $\phi$ M, $\phi$m, $\phi$c, and said parameters are characterized by coefficients which relate them all to the diameter $\phi$ M of the engine.

We claim:

1. In an air-cooled diesel machine of the type having a clyinder and a variable stroke free piston disposed therein for reciprocation and wherein said piston has an engine portion, a bounce portion and a compressor portion disposed intermediate said engine portion and said bounce portion, said compressor portion of said piston being disposed in a portion of said cylinder having a diameter greater than the engine portion and the bounce portion of the cylinder in which the engine portion and bounce portion of said piston are disposed respectively, the improvement comprising constructing said piston and cylinder so that the ratio of the diameter of the compressor portion of the piston to the diameter of the engine portion of the piston is between 1.6 and 1.9, the ratio of the diameter of the bounce portion of the piston to the diameter of the engine portion of the piston is between 0.8 and 1.2 and the ratio of the maximum stroke of the free piston to the diameter of the engine portion of the piston is between 1.5 and 1.8 with the maximum stroke of the piston being shorter than the axial length of the compressor portion of said cylinder whereby if the piston travels beyonds the normal dead point in the direction of the bounce portion of the cylinder due to lack of sufficient pressure in the compressor portion of the cylinder, the piston will be returned with insufficient force to accomplish ignition of the fuel-air mixture in the engine portion of the cylinder and the machine will stop without any shock caused by contact of the ends of the piston portions with the respective portions of the cylinder.

* * * * *